US007377632B2

(12) United States Patent
Kachi

(10) Patent No.: US 7,377,632 B2
(45) Date of Patent: May 27, 2008

(54) IMAGE RECORDING APPARATUS

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 410 days.

(21) Appl. No.: 11/093,306

(22) Filed: Mar. 30, 2005

(65) Prior Publication Data

US 2005/0219342 A1 Oct. 6, 2005

(30) Foreign Application Priority Data

Mar. 31, 2004 (JP) ..... 2004-107673

(51) Int. Cl.
*B41J 2/01* (2006.01)

(52) U.S. Cl. ..... 347/102; 347/104

(58) Field of Classification Search ..... 347/102, 347/19, 104

See application file for complete search history.

(56) References Cited

U.S. PATENT DOCUMENTS

| | | | | |
|---|---|---|---|---|
| 5,864,352 | A | 1/1999 | Aoki et al. | |
| 2001/0033318 | A1* | 10/2001 | Koitabashi et al. | 347/101 |
| 2003/0007055 | A1* | 1/2003 | Ogawa | 347/102 |
| 2003/0103661 | A1 | 6/2003 | Nakazawa et al. | |

FOREIGN PATENT DOCUMENTS

| | | | |
|---|---|---|---|
| JP | 2-179749 | A | 7/1990 |
| JP | 3-247450 | A | 11/1991 |
| JP | 4-173250 | A | 6/1992 |
| JP | 2000-71481 | A | 3/2000 |
| JP | 2001-270139 | A | 10/2001 |
| JP | 2003-153865 | A | 5/2003 |

* cited by examiner

*Primary Examiner*—An H. Do
(74) *Attorney, Agent, or Firm*—Birch, Stewart, Kolasch and Birch

(57) ABSTRACT

The image recording apparatus comprises: an inkjet head which has a plurality of nozzles discharging ink onto a recording medium; a conveyance device which performs relative conveyance of the recording medium relatively with respect to the inkjet head; and a fixing device which fixes the ink deposited on the recording medium from the plurality of nozzles, wherein the image recording apparatus records an image by discharging the ink onto the recording medium from the inkjet head while the relative conveyance by the conveyance device, and the image recording apparatus further comprises: a conveyance control device which controls a relative conveyance velocity of the recording medium in the relative conveyance with respect to the inkjet head; a discharge amount control device which controls an amount of the ink discharged from the inkjet head; a fixing control device which controls a fixing energy applied by the fixing device to fix the ink deposited on the recording medium; and a bleeding prevention control device which prevents the ink deposited on the recording medium from bleeding by variation-controlling at least one of the conveyance control device, the discharge amount control device, and the fixing control device.

3 Claims, 14 Drawing Sheets

| DETERMINATION RESULT | TARGET VALUE | CORRECTION FACTOR | WEIGHTING FACTOR |
|---|---|---|---|
| $D_{max}$ | $D_0$ | $a_1$ (≒1) | $f_1$ |
| LINE WIDTH E(A) | $A_B$ | $a_2$ (≒20) | $f_2$ |
| RAGGEDNESS $\sigma_{B-E(B)}$ | | $a_2$ (≒50) | $f_3$ |

FIG.17

| IMAGE QUALITY MODE | $f_1$ DENSITY | $f_2$ LINE WIDTH | $f_3$ RAGGEDNESS | REMARKS |
|---|---|---|---|---|
| TEXT | 1 | 3 | 3 | EMPHASIZE LINE WIDTH AND RAGGEDNESS |
| TEXT + IMAGE | 2 | 3 | 3 | EMPHASIZE LINE WIDTH, RAGGEDNESS, AND CERTAIN DENSITY |
| IMAGE | 3 | 3 | 3 | EMPHASIZE ALL |

FIG.18

| IMAGE QUALITY MODE | CONVEYANCE VELOCITY | FIXING ENERGY | PARTICLE DIAMETER |
|---|---|---|---|
| TEXT | $V_{max}$ | VARIABLE | $\phi_{Hi}$ |
| TEXT +IMAGE | $V_{max} \sim V_{min}$ | VARIABLE | VARIABLE |
| IMAGE | VARIABLE | VARIABLE | VARIABLE |

IMAGE RECORDING APPARATUS

BACKGROUND OF THE INVENTION

1. Field of the Invention

The present invention relates to an image recording apparatus, and more particularly to an image recording apparatus that discharges ink from multiple nozzles onto a recording medium to record an image, wherein the ink is prevented from bleeding.

2. Description of the Related Art

Conventionally, one known example of an image forming apparatus is an inkjet recording apparatus (inkjet printer) that has an inkjet head (ink discharge head) with an alignment of multiple nozzles and that forms an image on a recording medium by discharging ink from the nozzles while moving the inkjet head and the recording medium relative to each other.

Various methods are known in conventional practice as ink discharge methods for such an inkjet recording apparatus. Known examples include a piezoelectric system wherein a vibration plate that constitutes part of a pressure chamber (ink chamber) is deformed by the deformation of a piezoelectric element (piezoelectric ceramics), the capacity of the pressure chamber is changed, ink is led into the pressure chamber from an ink supply channel during this increase in pressure chamber capacity, and the ink in the pressure chamber is discharged as droplets during the decrease in pressure chamber capacity. Further, known examples also include a thermal inkjet system wherein ink is heated to create air bubbles for discharging the ink by the expansion energy when the air bubbles grow.

In image recording apparatuses that have ink discharge heads such as an inkjet recording apparatus, ink is supplied from an ink-storing tank to ink discharge heads via an ink supply channel, and the ink is discharged by the various discharge methods described above, but depending on the type of ink or the type of recording medium, the ink dots (ink droplets) may bleed after striking the recording medium, or the dot shapes may break up and cause the image to fade. When a color image is recorded using a plurality of inks with different colors, if an image is recorded by overlapping ink of a different color on previously recorded ink that has not yet dried, then problems are encountered with the colors bleeding or mixing together and adversely affecting the image quality.

In view of this, various methods have been proposed in conventional practice for improving the image quality by preventing the image from fading due to the ink bleeding, or preventing the colors from bleeding or mixing together when an image is recorded by overlapping inks of different colors.

In one known example, during one rotation of the rotating body that holds the recording medium, the ink dots of various colors sprayed from the recording heads of various colors are recorded on the recording medium by pixel skipping in a state of separation by at least one dot in the sub-scanning direction, which is the same as the rotational direction, thus preventing adjacent ink dots from mixing or flowing together and recording a high-quality image (for example, see Japanese Patent Application Publication No. 2000-71481).

In another known example, an inkjet recording apparatus has a device for estimating the dried state of the recorded ink, and the velocity at which the recording medium is conveyed is varied and the intervals between recording heads are varied according to the results of this estimation, whereby the recording interval between one recording and the next is varied to maintain the throughput of the recording apparatus, which prevents recording discrepancies in sections where different inks overlap and improves the image quality (for example, see Japanese Patent Application Publication No. 03-247450).

In another known example, in a color inkjet recording method, a color print free of smearing between colors is obtained by performing a routine in which printing by at least one of a plurality of heads is performed after a time that is sufficiently longer than the print lag time of adjacent heads is allowed to pass before printing is performed by the other heads in the same printed area (for example, see Japanese Patent Application Publication No. 04-173250).

However, for example, the example described in Japanese Patent Application Publication No. 2000-71481 is disadvantageous in that during one rotation of the rotating body that holds the recording medium, an image is recorded with single-dot pixel skipping, a plurality of rotations are needed to record an entire image, and the productivity is reduced.

Also, the example described in Japanese Patent Application Publication No. 03-247450 has a device for estimating drying and a device for adjusting the dot recording intervals. The device is designed to adjust the intervals at which the next dots are recorded according to the dried state, but this example does not have a fixing device for drying and hardening the ink that strikes the recording medium and relies merely on natural drying. The device is disadvantageous in that mixed color fading and image bleeding cannot necessarily be reliably prevented.

Furthermore, the example described in Japanese Patent Application Publication No. 04-173250 merely uses a time greater than the print lag between adjacent dots, does not have a device for drying and hardening, and is subject to the same problems as Japanese Patent Application Publication No. 03-247450.

SUMMARY OF THE INVENTION

The present invention has been contrived in view of such circumstances, and an object thereof is to provide an image recording apparatus wherein is it possible to record high-quality images at high speeds while preventing ink from bleeding on the surface of the recording medium.

In order to attain the aforementioned object, the present invention is directed to an image recording apparatus, comprising: an inkjet head which has a plurality of nozzles discharging ink onto a recording medium; a conveyance device which performs relative conveyance of the recording medium relatively with respect to the inkjet head; and a fixing device which fixes the ink deposited on the recording medium from the plurality of nozzles, wherein the image recording apparatus records an image by discharging the ink onto the recording medium from the inkjet head while the relative conveyance by the conveyance device, and the image recording apparatus further comprises: a conveyance control device which controls a relative conveyance velocity of the recording medium in the relative conveyance with respect to the inkjet head; a discharge amount control device which controls an amount of the ink discharged from the inkjet head; a fixing control device which controls a fixing energy applied by the fixing device to fix the ink deposited on the recording medium; and a bleeding prevention control device which prevents the ink deposited on the recording medium from bleeding by variation-controlling at least one of the conveyance control device, the discharge amount control device, and the fixing control device.

According to the present invention, it is possible to prevent the ink from bleeding on the surface of the recording medium and to record high-quality images at high speeds. Bleeding prevention by the bleeding prevention device as referred to herein does not mean only that the amount by which the dots expand (for example, sections in which the ink permeates the recording medium and expands as shown by the symbols d1 and d2 in FIG. 4A, described later) is brought completely to 0, but also includes at least the concept of reducing such expansion.

Preferably, the image recording apparatus further comprises: a bleeding evaluation print output device which outputs a bleeding evaluation print composed of a plurality of recorded bleeding patches obtained by varying, in a plurality levels, at least one of the relative conveyance velocity, the amount of the ink discharged, and the fixing energy as a parameter, wherein the bleeding prevention control device controls the at least one of the conveyance control device, the discharge amount control device, and the fixing control device according to the bleeding evaluation print outputted by the bleeding evaluation print output device.

Preferably, the bleeding evaluation patches constitute a visible resolution chart composed of a plurality of line segments of a specific width that are recorded at specific intervals for respective colors so that the specific width and the specific intervals gradually decrease.

Ink bleeding can thereby be evaluated in image recordings under various image-recording conditions, ink bleeding can be visually evaluated, and it is possible to record images wherein ink bleeding has been prevented.

Preferably, the image recording apparatus further comprises: a parameter setting device which includes at least one of a medium type determination device which determines a type of the recording medium and an ink type determination device which determines a type of the ink, the parameter setting device setting control parameters for controlling the conveyance control device, the discharge amount control device, and the fixing control device according to the outputted bleeding evaluation print and at least determined one of the type of the medium and the type of the ink, wherein the bleeding prevention control device controls the at least one of the conveyance control device, the discharge amount control device, and the fixing control device according to the set control parameters.

It is thereby possible to set image recording conditions for each type of ink and recording medium such that no bleeding occurs in the ink discharged onto the recording medium, and a high-quality, bleed-free image can be obtained irrespective of the type of ink or recording medium.

If the bleeding prevention control device variation-controls the conveyance control device, then it is preferable that the image recording apparatus further comprises a frequency control device which controls a discharge frequency of the inkjet head in such a manner that the image is recorded with a prescribed dot pitch. The dot pitch of the recorded image can thereby be kept constant, and consistent image quality can be maintained.

As described above, according to the image recording apparatus relating to the present invention, it is possible to prevent ink from bleeding on the surface of the recording medium and to record high-quality images at high speeds. Also, it is possible to set the image recording conditions so that bleeding does not occur in the ink discharged onto the recording medium even if the type of ink or recording medium varies, and high-quality, bleed-free images can be obtained.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 4A to 4D are explanatory diagrams showing the principles of the method for preventing ink from bleeding in a permeable recording medium, wherein FIGS. 4A and 4B depict a case with solvent-based ink, and FIGS. 4C and 4D depict a case with matrix-curing ink;

FIGS. 5A to 5D are explanatory diagrams showing the principles of the method for preventing ink from bleeding in an impermeable recording medium, wherein FIGS. 5A and 5B depict a case with solvent-based ink, and FIGS. 5C and 5D depict a case with matrix-curing ink;

FIG. 17 is an explanatory diagram showing the relationship between image quality mode and weighting factor;

FIG. 18 is an explanatory diagram showing the controlled variable parameters when options are limited.

DETAILED DESCRIPTION OF THE PREFERRED EMBODIMENTS

The image recording apparatus according to the present invention will be described in detail below with reference to the attached drawings.

Figure 1:
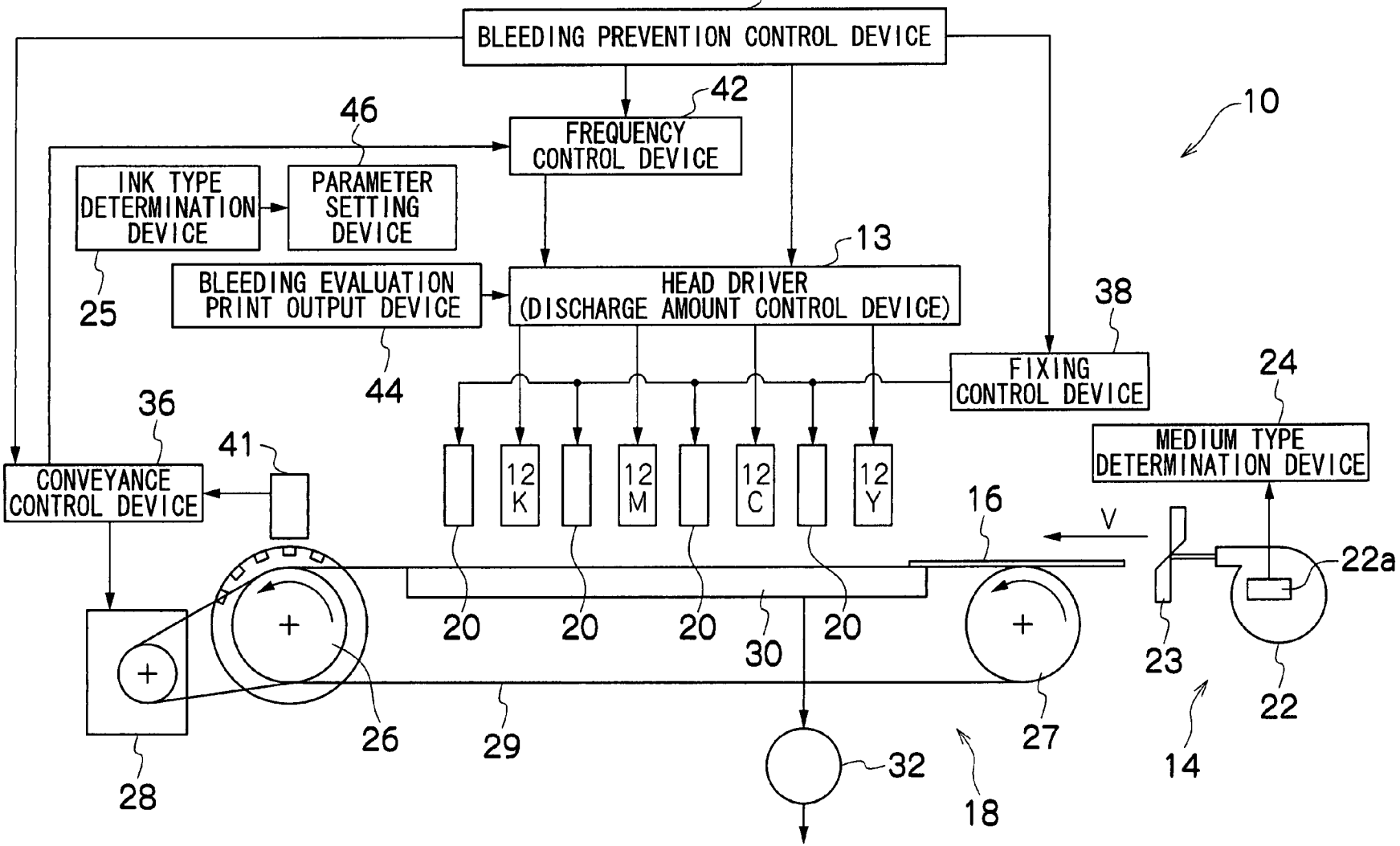
FIG. 1 is a general schematic drawing of an inkjet recording apparatus according to first embodiment of the present invention.

In the present invention, first embodiment of the image recording apparatus is explained as example of an inkjet recording apparatus in the following FIG. 1 is a general schematic drawing of an inkjet recording apparatus according to first embodiment of the present invention, showing at a block diagram in part.

As shown in FIG. 1, the inkjet recording apparatus 10 comprises: a printing unit 12 having a plurality of print heads 12Y, 12C, 12M, and 12K for ink colors of yellow (Y), cyan (C), magenta (M), and black (K), respectively; a head driver 13 for controlling to drive the print heads 12Y, 12C, 12M, and 12K; a conveyance unit 18 for supplying a recording paper 16 as a recording medium from a paper supply unit 14 to the print heads 12Y, 12C, 12M, and 12K; and a fixing device 20 for fixing the ink deposited on the recording paper 16.

In FIG. 1, a magazine 22 for rolled paper (continuous paper) is shown as an example of the paper supply unit 14; however, a plurality of magazines with paper differences such as paper width and quality may be jointly provided. Moreover, paper may be supplied with a cassette that contains cut paper loaded in layers and that is used jointly or in lieu of a magazine 22 for rolled paper.

In the case of the configuration in which roll paper is used, a cutter 23 is provided as shown in FIG. 1, and the continuous paper is cut into a desired size by the cutter 23. When cut paper is used, the cutter 23 is not required.

The recording paper 16 delivered from the magazine 22 retains curl due to having been loaded in the magazine 22. In order to remove the curl, heat is applied to the recording paper 16 in the decurling unit (not shown) by a heating drum in the direction opposite from the curl direction in the magazine 22. The heating temperature at this time is preferably controlled so that the recording paper 16 has a curl in which the surface on which the print is to be made is slightly round outward.

The conveyance unit 18 has a configuration in which an endless belt 29 is set around rollers 26 and 27 so that the portion of the endless belt 33 facing at least the nozzle face of the print heads 12Y, 12C, 12M, and 12K forms a horizontal plane (flat plane).

The belt 29 is driven in the counterclockwise direction in FIG. 1 by the motive force of a motor 28 being transmitted to at least one of the rollers 26 and 27 (for example, the roller 26 of the left-hand side as shown in FIG. 1), which the belt 29 is set around, and the recording paper 16 held on the belt 29 is conveyed from right to left in FIG. 1 at the (relative) conveyance velocity V.

Figure 2:
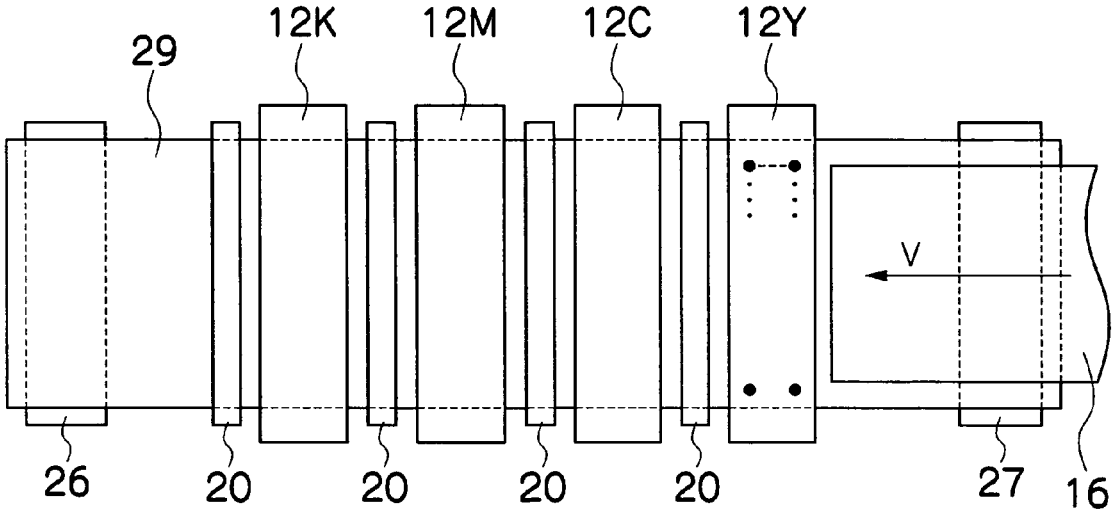
FIG. 2 is a plan view of principal components of an area around a printing unit of the inkjet recording apparatus in FIG. 1.

FIG. 2 shows a plan view of principal components of an area around the print heads 12Y, 12C, 12M, and 12K. As shown in FIG. 2, the print heads 12Y, 12C, 12M, and 12K each have a plurality of nozzles corresponding to each color (YCMK) and are configured with the longitudinal direction of the print heads 12Y, 12C, 12M, and 12K aligned with the paper width direction orthogonal to the direction in which the recording paper 16 is conveyed so as to extend over the entire width of the recording paper 16, forming a full-line head with a length corresponding to the maximum paper width.

The full-line head mentioned herein includes a configuration wherein a plurality of rectangular recording heads are aligned in the width direction of the recording paper.

Also, a fixing device 20 with lengths corresponding to the entire width of the recording paper 16 are disposed between the print heads 12Y, 12C, 12M, and 12K.

As shown in FIGS. 1 and 2, the print heads 12Y, 12C, 12M, and 12K are arranged in this order from the upstream side along the paper conveyance direction (from right to left in FIGS. 1 and 2). A color print can be formed on the recording paper 16 by discharging the inks from the print heads 12K, 12C, 12M, and 12Y, respectively, onto the recording paper 16 while conveying the recording paper 16 by the conveyance unit 18.

Although the configuration with the YCMK four standard colors is described in the present embodiment, combinations of the ink colors and the number of colors are not limited to those, and light and/or dark inks can be added as required. For example, a configuration is possible in which print heads for discharging light-colored inks such as light cyan and light magenta are added.

The print heads 12Y, 12C, 12M, and 12K are driven by the head driver 13, and the discharged amount, discharge timing, and other parameters of the ink discharged is controlled.

Thus, with the print heads 12Y, 12C, 12M, and 12K in which a full-line head covering the entire paper width is provided with each ink color, an image can be recorded at a high speed over the entire surface of the recording paper 16 merely by performing a single operation in which the recording paper 16 and the print heads 12Y, 12C, 12M, and 12K are moved relative to the direction in which the paper is conveyed (specifically, by a single scan).

However, the present invention is not limited to a linear head, and can also be applied to a shuttle head in which the print heads move back and forth in the direction (paper width direction) orthogonal to the paper conveyance direction.

In the present example, a configuration with the standard colors (four) YCMK is described, but the combination of the ink colors and the number of colors is not limited to the present embodiment, and light or dark ink may be added as necessary. For example, another possibility is a configuration in which a print head that discharges light cyan, light magenta, or another such light ink is added.

Also, an ink type determination device 25 for determining the type of ink is provided near an ink tank (not shown) for supplying ink of each color to the print heads 12Y, 12C, 12M, and 12K. The ink type determination device 25 is not particularly limited, and may, in the case of a cartridge-type ink tank, for example, have a configuration wherein ID indicating the ink type is read out from an information medium or the like attached to the cartridge.

The fixing device 20 provides the ink discharged from the print heads 12Y, 12C, 12M, and 12K onto the recording paper 16 with fixing energy so as to fix the ink onto the recording paper 16, and a suitable device is used according to the ink employed.

The term "fixing" used herein refers to the process of ink no longer existing as droplets on the recording paper surface due to the permeation of ink deposited on the recording paper 16 into the fibers of the paper and the drying or curing of ink from the surface, and the ink ceasing to move and being fixed in place. A possible example of drying, in the case of water-based ink, is when thermal energy is provided as drying energy to evaporate the water, which is a solvent for ink, thereby drying the ink. If a drying device is used as the fixing device 20, examples include a heater, an infrared ray irradiation device, or a fan (heating fan) for blowing air (hot air), and these devices may be used individually or a plurality thereof may be used.

Also, a method of curing by causing a condensation reaction using curable ink has been considered as a method for curing and fixing the ink on the recording paper 16. For example, the ink may be cured and fixed on the recording paper 16 by using ultraviolet (UV) curable ink or ink commonly curable with electromagnetic radiation, exposing the ink to electromagnetic radiation or electron beam (EB), and providing the ink with thermal energy. In this case, matrix-curing ink such as UV curable ink or solid ink can be used as the curable ink, for example. With UV curable ink, a UV ray irradiation device, a halogen lamp, a laser light emitting diode, or the like are possible examples, and with solid ink, possible examples include a Peltier device or a water cooling device, or a fan or another such cooling device.

In ink that undergoes a phase transition due to heat, such as wax ink, the ink can be made into liquid form by providing thermal energy to the head, for example, and can be solidified by cooling after being discharged onto the recording medium. Also, with sol-gel ink, discharge and fixing can be controlled similarly by the device of thermal energy.

The fixing device 20 is disposed after each of the four print heads 12Y, 12C, 12M, and 12K, as shown in FIG. 1, ensuring that the ink discharged from the print heads is fixed and does not bleed, and that the inks do not mix together when discharged near the same area from the next print head.

The present embodiment prevents the ink deposited on the recording paper 16 from bleeding and records high-quality images by variably controlling at least one of the conveyance velocity of the recording paper 16 relative to the inkjet heads (the print head 12Y and the like), the amount of ink discharged, and the fixing energy for fixing the ink deposited on the 16. The amount of ink discharged herein is controlled by the head driver 13 as previously described, and the head driver 13 acts as the discharge amount control device.

In order to achieve such bleeding prevention control, the inkjet recording apparatus 10 of the present embodiment has, in addition to the head driver 13 as a discharge amount control device for controlling the amount of ink discharged, a conveyance control device 36 for controlling the relative conveyance velocity of the recording paper 16, a fixing control device 38 for controlling the fixing energy of the fixing device 20 for fixing the ink, and a bleeding prevention control device 40 for preventing the ink from bleeding by variably controlling at least one of these three control devices, namely, the discharge amount control device (head driver 13), the conveyance control device 36, and the fixing control device 38.

Also, an encoder 41 for determining the relative conveyance velocity in order to control this velocity is installed on a roller 26. Furthermore, the inkjet recording apparatus 10 has a frequency control device 42 for controlling the discharge frequency of the print heads (12Y and the like) when the relative conveyance velocity is controlled so that the recorded image has a specific dot pitch.

Also, in order to prevent ink from bleeding and to record high-quality images, the inkjet recording apparatus 10 of the present embodiment has a bleeding evaluation print output device 44 which outputs a bleeding evaluation print used to evaluate ink bleeding (described later), and a parameter setting device 46 for setting the optimum values of the controlled amounts as control parameters on the basis of the bleeding evaluation results that use the outputted bleeding evaluation print.

The discharge amount control device (head driver 13) controls the amount of ink discharged from the print heads 12Y, 12C, 12M, and 12K onto the recording paper 16, and, for example, although this is not shown in the diagram, controls the amount of ink discharged by controlling the ink internal pressure in the ink chamber or the driven amount of the actuator (piezoelectric element) that deforms the ink chamber. The size of the discharged ink droplets, or, specifically, the diameter of the ink deposited on the surface of the recording paper 16, can be controlled by controlling the amount of ink discharged.

The conveyance control device 36 controls the rotational frequency of a motor 28 on the basis of a determination signal from a rotary encoder 41. At this time, when the optimum relative conveyance velocity is parametrically set, the rotation of the motor 28 is controlled so that the relative conveyance velocity of the recording paper 16 reaches the optimum velocity.

The fixing control device 38 solidifies the ink to prevent bleeding by fixing the ink through a procedure in which the energy is controlled according to the type of ink and the type of medium (the type of the recording paper 16), thermal energy is provided to the ink deposited on the recording paper 16, and hot air is blown with a fan.

The principles of the method for controlling ink bleeding in this manner will be described in detail later.

The bleeding prevention control device 40 prevents the ink from bleeding by controlling at least one of the head driver 13 (discharge amount control device), the conveyance control device 36, and the fixing control device 38. The specific control method is performed by controlling each of the control devices according to the parameters set as the optimum control values by the parameter-setting device 46 as is described later.

Also, the frequency control device 42 controls the ink discharge timing from the print heads 12Y, 12C, 12M, and 12K in accordance with the relative conveyance velocity of the recording paper 16 when it has been varied, and ensures that the recorded image is an image with a specific dot pitch.

Figure 3:
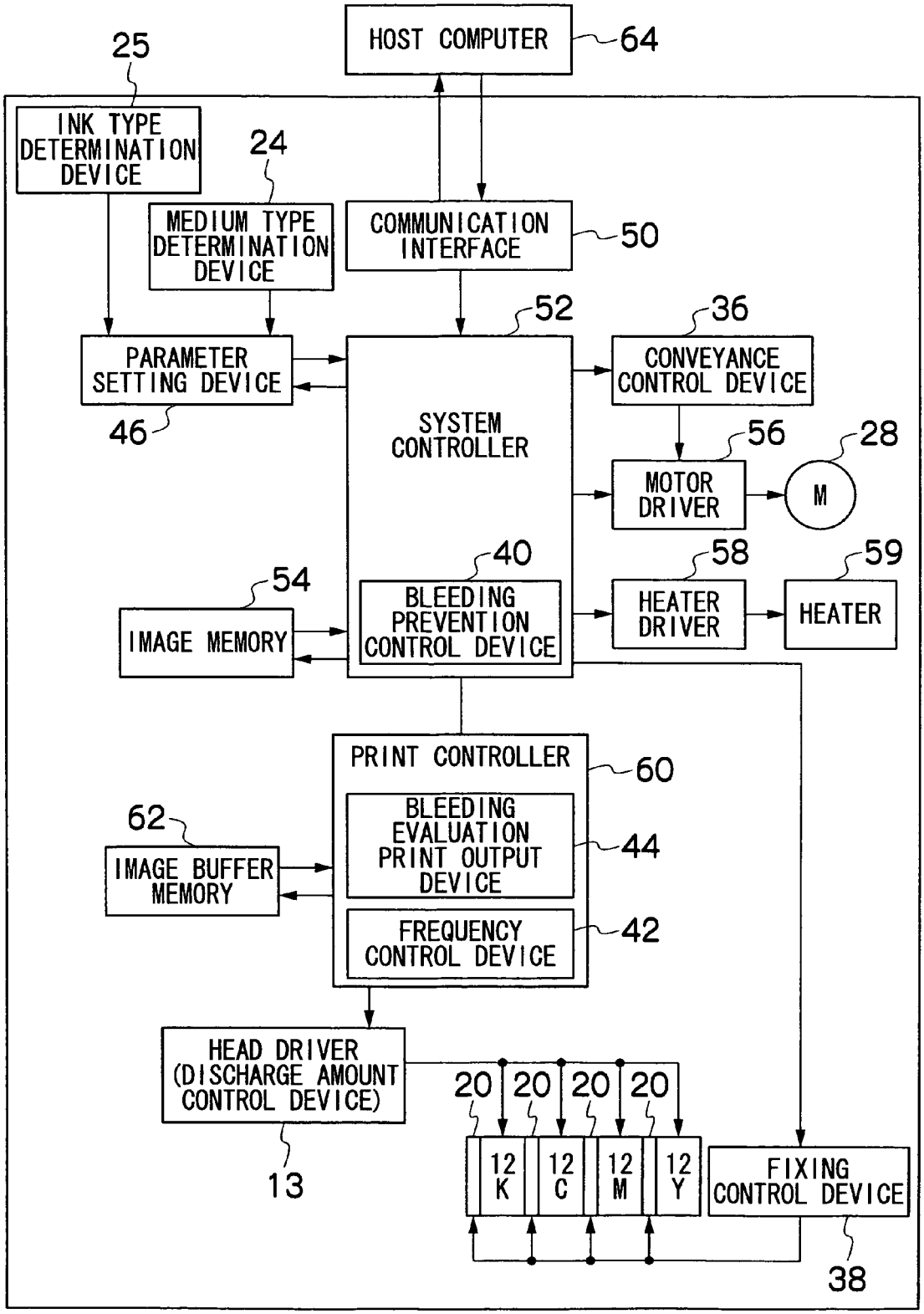
FIG. 3 is a block diagram of principal components showing a system configuration of the inkjet recording apparatus.

FIG. 3 is a block diagram of the principal components showing the system configuration of the inkjet recording apparatus 10. The inkjet recording apparatus 10 has a communication interface 50, a system controller 52, an image memory 54, a motor driver 56, a heater driver 58, a print controller 60, an image buffer memory 62, the head driver 13, and other components.

The communication interface 50 is an interface unit for receiving image data sent from a host computer 64. A serial interface such as USB, IEEE1394, Ethernet, wireless network, or a parallel interface such as a Centronics interface may be used as the communication interface 50. A buffer memory (not shown) may be mounted in this portion in order to increase the communication speed. The image data sent from the host computer 64 is received by the inkjet recording apparatus 10 through the communication interface 50, and is temporarily stored in the image memory 54. The image memory 54 is a storage device for temporarily storing images inputted through the communication interface 50. The image memory 54 is not limited to memory composed of a semiconductor element, and a hard disk drive or another magnetic medium may be used.

The system controller 52 controls the communication interface 50, image memory 54, motor driver 56, heater driver 58, and other components. The system controller 52 has a central processing unit (CPU), peripheral circuits therefore, and the like. The system controller 52 controls communication between itself and the host computer 64, controls reading and writing from and to the image memory 54, and performs other functions, and also generates control signals for controlling a heater 59 and the motor 28 in the conveyance system.

The motor driver (drive circuit) 56 drives the motor 28 in accordance with commands from the system controller 52. The heater driver (drive circuit) 58 drives the heater 59 of the post-drying unit (not shown) or the like in accordance with commands from the system controller 52.

The print control unit 60 is a control unit having a signal processing function for performing various treatment processes, corrections, and the like, in accordance with the control implemented by the system controller 52, in order to generate a signal for controlling printing, from the image data in the image memory 54, and it supplies the print control signal (image data) thus generated to the head driver 36. Prescribed signal processing is carried out in the print control unit 60, and the discharge amount and the discharge timing of the ink droplets from the respective print heads 12Y, 12C, 12M, and 12K are controlled via the head driver 36, on the basis of the image data. By this means, prescribed dot size and dot positions can be achieved.

The print control unit 60 is provided with the image buffer memory 62; and image data, parameters, and other data are temporarily stored in the image buffer memory 62 when image data is processed in the print control unit 60. The aspect shown in FIG. 3 is one in which the image buffer memory 62 accompanies the print control unit 60; however, the image memory 54 may also serve as the image buffer memory 62. Also possible is an aspect in which the print control unit 60 and the system controller 52 are integrated to form a single processor.

The head driver 13 drives actuators for the print heads 12Y, 12C, 12M and 12K of the respective colors on the basis of the print data received from the print control unit 60. A feedback control system for keeping the drive conditions for the print heads constant may be included in the head driver 13.

The inkjet recording apparatus 10 in the present embodiment also has, as other devices for bleeding avoidance control, the conveyance control device 36 for controlling the relative conveyance velocity V of the recording paper 16, the fixing control device 38 for controlling the fixing energy of the fixing device 20, the frequency control device 42 for controlling the ink output frequency according to the relative conveyance velocity V when it has been varied, the parameter setting device 46 for setting control parameters for controlling each of the control devices, and the bleeding evaluation print output device 44 which outputs a bleeding evaluation print.

Also, the type of medium determined by the medium type determination device 24 and the type of ink determined by the ink type determination device 25 are inputted to the parameter setting device 46. Though described in detail later, the parameter-setting device 46 assigns, sets, and stores control parameters for controlling each control devices to avoid bleeding according to the type of medium and the type of ink. The bleeding evaluation print output device 44 forms data for the bleeding evaluation patches constituting the bleeding evaluation print, then sends the data to the print heads 12Y, 12C, 12M, and 12K through the head driver 13, and outputs the data as a bleeding evaluation print. Alternatively, the bleeding evaluation print output device 44 may read out the data for the bleeding evaluation patches from the memory instead of creating the data each time.

The frequency control device 42 and the bleeding evaluation print output device 44 are mounted in a print control unit 60 and are designed to be controlled by a system controller 52. Also, although this is described in detail later, the operator visually evaluates bleeding of ink by observing the bleeding evaluation patches of the bleeding evaluation print.

Furthermore, the system controller 52 is provided with a bleeding prevention control device 40 that controls each of the control devices to avoid bleeding by each device of the control parameters set by the parameter setting device 46.

Next, the principles of the method for avoiding ink bleeding will be described using the diagrams. FIGS. 4A to 4D show a permeable recording medium (recording paper 16), and FIGS. 5A to 5D show an impermeable recording medium. The permeable recording medium is normal paper, copying paper, groundwood paper, or other such paper wherein the ink is fixed by permeating into the image reception layer in the recording medium, and the impermeable recording medium is art paper for printing, coating paper, or other such recording medium that is resistant to permeation by an ink solvent, and ink is primarily fixed on the surface of the recording medium by solidifying (curing).

Figure 4A:
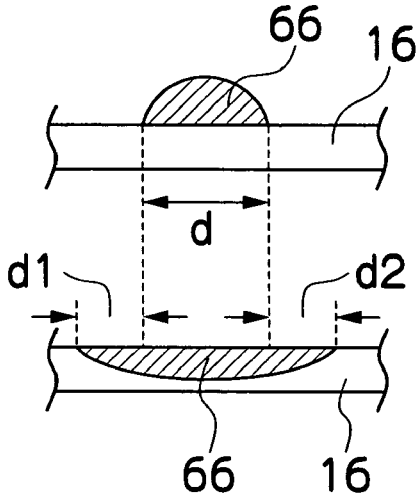
Figure 4B:
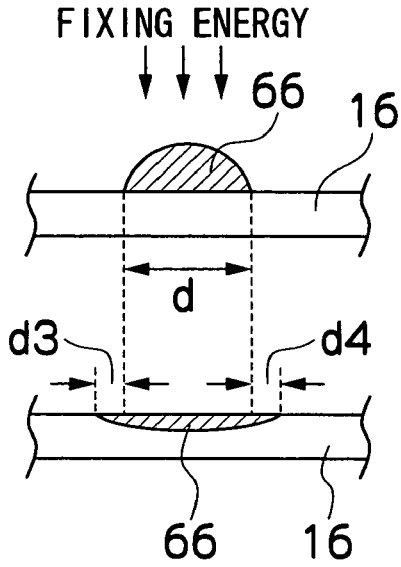
Figure 4C:
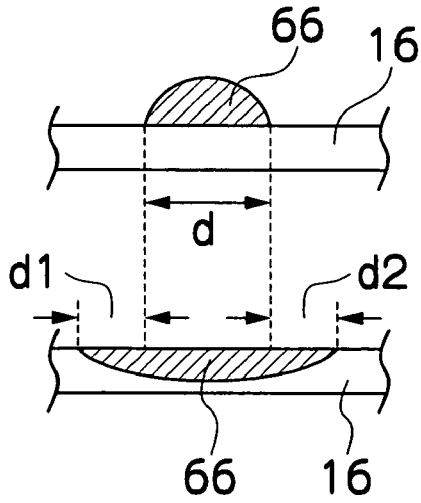
Figure 5A:
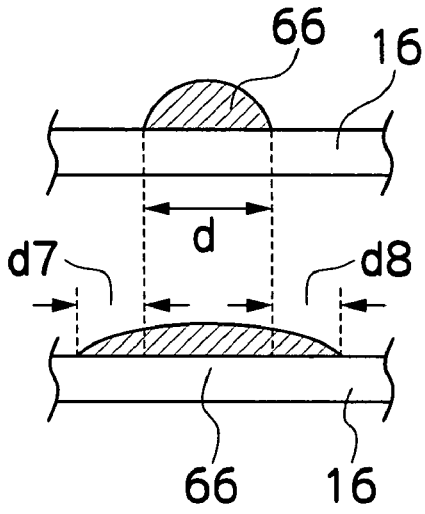
Figure 5B:
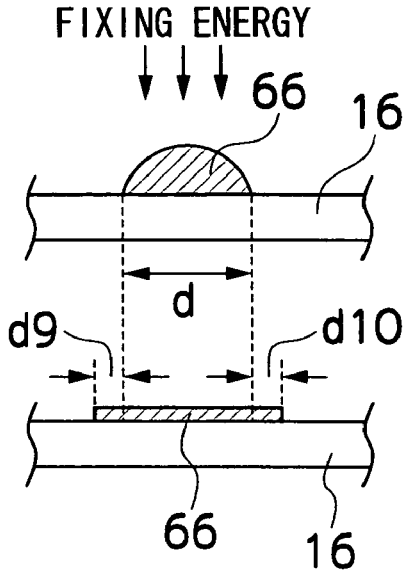
Figure 5C:
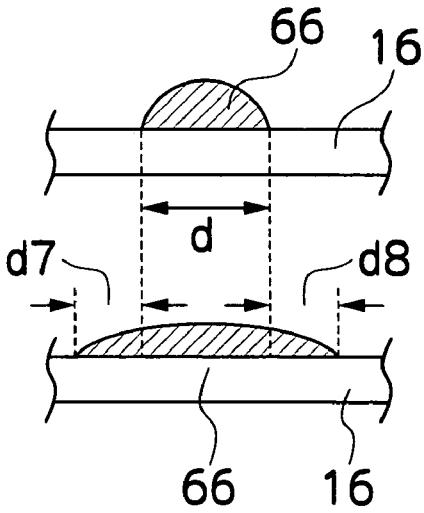

If the recording medium (recording paper 16) is permeable, bleeding refers to sections (d1 and d2) wherein the ink permeates the recording medium and expands so that the resulting diameter is greater than the dot diameter d of the ink 66 discharged from the print heads (12Y and the like) and deposited on the recording medium, as shown in FIG. 4A or 4C. If the recording medium is impermeable, bleeding refers to sections (d7 or d8) wherein the shape of the ink on the recording medium ruptures and expands to be greater than the dot diameter d of the ink 66 discharged from the print heads (12Y and the like) and deposited on the recording medium, as shown in FIG. 5A or 5C.

Particularly, if the recording medium is permeable, bleeding in which the permeating ink expands in a radial pattern along the fibers of the recording medium is sometimes referred to as feathering.

First, if the recording medium (recording paper 16) is permeable, the ink 66 deposited on the recording paper 16 permeates the recording paper 16 and expands, and bleeding (d1, d2) occurs due to the medium permeating pressure, as shown in FIG. 4A or 4C.

In view of this, if the ink 66 is water-based ink, oil-based ink, or another such solvent-based ink, the solvent is dried by providing thermal energy or other such drying energy (fixing energy), and bleeding (d3, d4) due to permeation into the recording paper 16 is reduced, as shown in FIG. 4B.

Figure 4D:
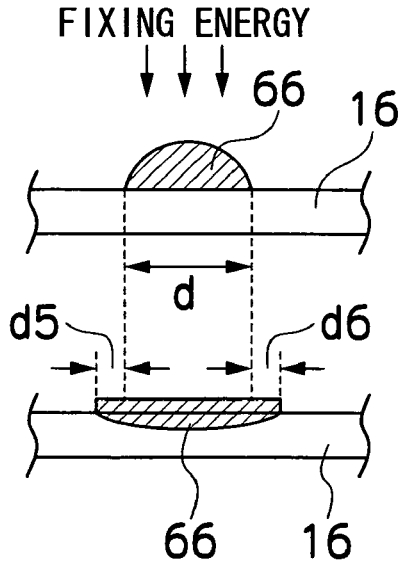

Also, if the ink 54 is UV curable ink, solid ink, EB curable ink, or another such matrix-curable ink, curing energy (fixing energy) is provided to cure and thicken the ink 54, and bleeding (d5, d6) is reduced as shown in FIG. 4D.

Next, if the recording medium (recording paper 16) is impermeable, the ink 66 deposited on the recording paper 16 does not permeate the recording paper 16 but expands on the recording paper 16 due to the relationship between the surface energies of the ink and the recording paper, and bleeding (d7, d8) occurs, as shown in FIG. 5A or 5C.

In view of this, if the ink 66 is water-based, oil-based, or another such solvent-based ink, thermal energy or other such drying energy (fixing energy) is provided to evaporate the solvent, and expansion of the ink 66 is avoided to reduce bleeding (d9, d10).

Figure 5D:
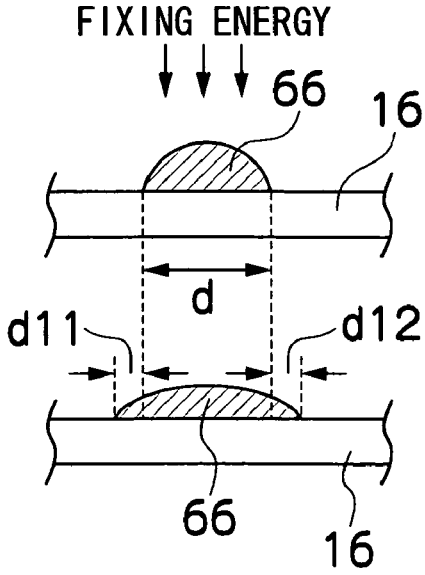

Also, if the ink 66 is UV curable ink, solid ink, EB curable ink, or another such matrix-curable ink, curing energy (fixing energy) is provided to cure and thicken the ink 66, expansion of the ink 66 is suppressed as shown in FIG. 5D, and bleeding (d11, d12) is reduced.

Another method that has been considered for avoiding ink bleeding, in addition to the method wherein the ink 66 deposited on the recording paper 16 is provided with drying energy and curing energy in this manner to suppress the ink 66 from expanding, is a method of reducing the particle diameter of the discharged ink. With a solvent-based ink, bleeding of the ink on the recording paper 16 is reduced by reducing the amount of ink through reduction of the particle diameter of the discharged ink. With matrix-curable ink, the thickness of ink deposited on the recording paper 16 is reduced by reducing the particle diameter of the ink, and the curing reaction speed is increased to prevent the shape of the ink dots from expanding and to reduce bleeding.

Next, the method for setting the optimum parameters for preventing ink bleeding will be described.

In order to achieve this, first a bleeding evaluation print (bleeding evaluation pattern) is created.

The bleeding evaluation pattern is used to evaluate the manner in which the ink bleeds depending on the difference in conditions, and is created by varying the ink discharge amount (ink particle diameter $\phi$), the relative conveyance velocity, and the fixing energy E to discharge ink from the print heads 12Y, 12C, 12M, and 12K onto the recording paper 16.

Figure 6:
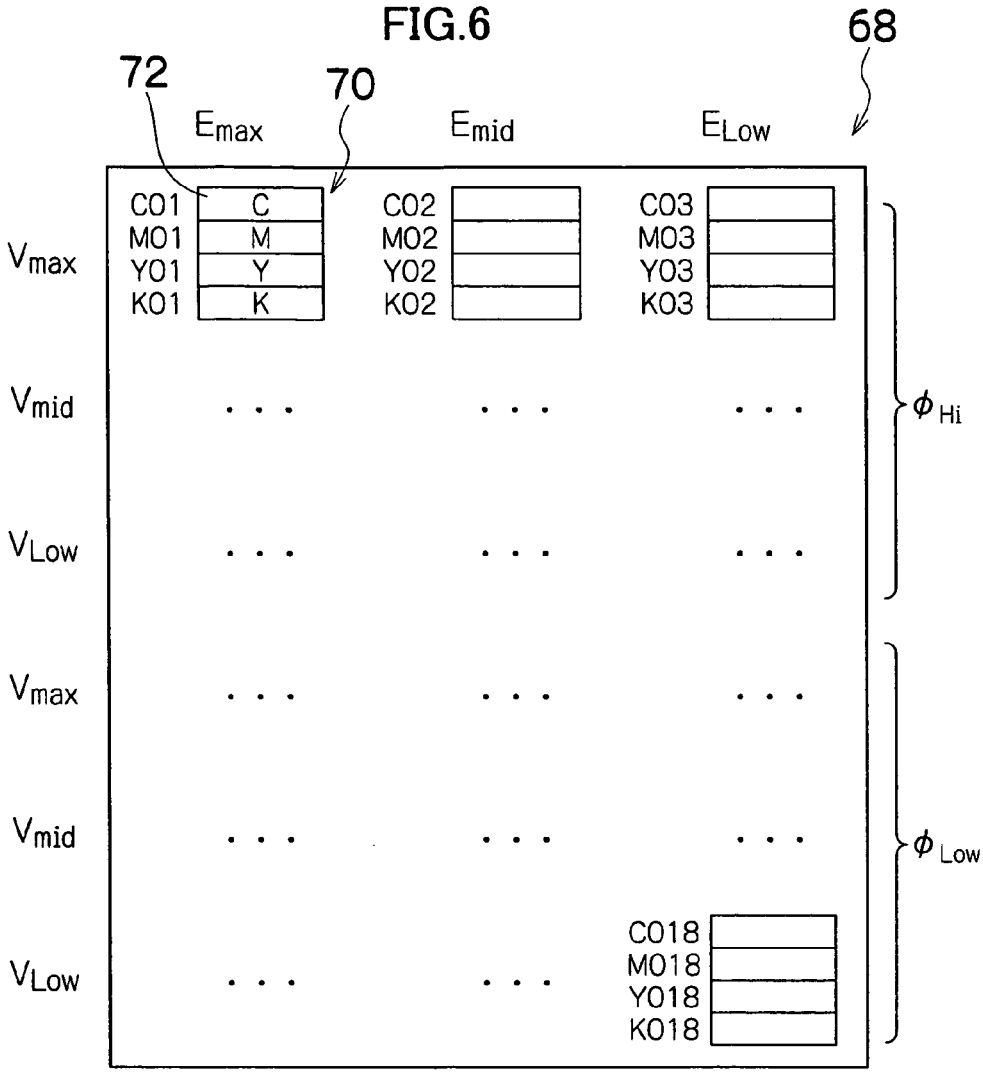
FIG. 6 is an explanatory diagram showing an example of a bleeding evaluation print.

FIG. 6 shows an example of a bleeding evaluation print. As shown in FIG. 6, the bleeding evaluation print 68 is configured by recording bleeding evaluation patches 70 for each ink color by a procedure in which the ink particle diameter is varied in two stages of large $\phi_{Hi}$ and small $\phi_{low}$, and the relative conveyance velocity V and the fixing energy E are each varied in three stages, high, medium, and low. Also, the bleeding evaluation patches 70 are not limited to those shown herein, and may include other parameters, for example, the printing environment temperature and moisture, or other factors relating to the bleeding of ink.

Figure 7:
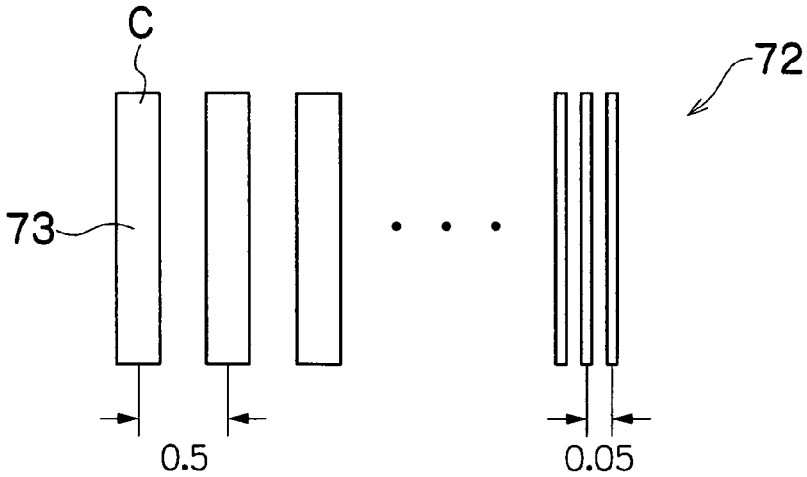
FIG. 7 is an explanatory diagram showing an enlargement of an example of bleeding evaluation patches.

As shown FIG. 7, patches 72 for each color in the bleeding evaluation patches 70 are recorded while a plurality of line segments 73 of specific lengths are gradually narrowed in width and intervals. The intervals between these line segments 73 are initially 0.5 mm, for example, as shown in FIG. 7, but are gradually narrowed ultimately to 0.05 mm. The spaces between the areas of ink do not have ink discharged thereon and are the original color of the recording paper 16 (normally white). Therefore, the patches 72 are configured by alternately aligning the ink color and white (the original color of the recording paper 16).

Thus, patches formed by line segments of each color are recorded in the bleeding evaluation print 68 by varying the ink discharge amount (ink particle diameter $\phi$) in two stages and varying the relative conveyance velocity V and the fixing energy E both in three stages. Eventually, 2×3×3=18 of the bleeding evaluation patches 70 each are formed. Numbers (chart Nos.) such as C01-C18, M01-M18, etc. are assigned to the patches 72 of each color of the bleeding evaluation patches 70 and are used to set the control parameters as is described later.

The operator visually evaluates the bleeding evaluation print 68. Specifically, as shown in FIG. 7, the patches 72 of each color forming the bleeding evaluation patches 70 of the present embodiment form a resolution chart such that the line widths and intervals thereof gradually decrease. Bleeding is evaluated since the operator can visually evaluate as to where the line segments extend in the resolution chart that become gradually narrower.

Next, the operation of the present invention will be described referring to the flowchart in FIG. 8.

Figure 8:
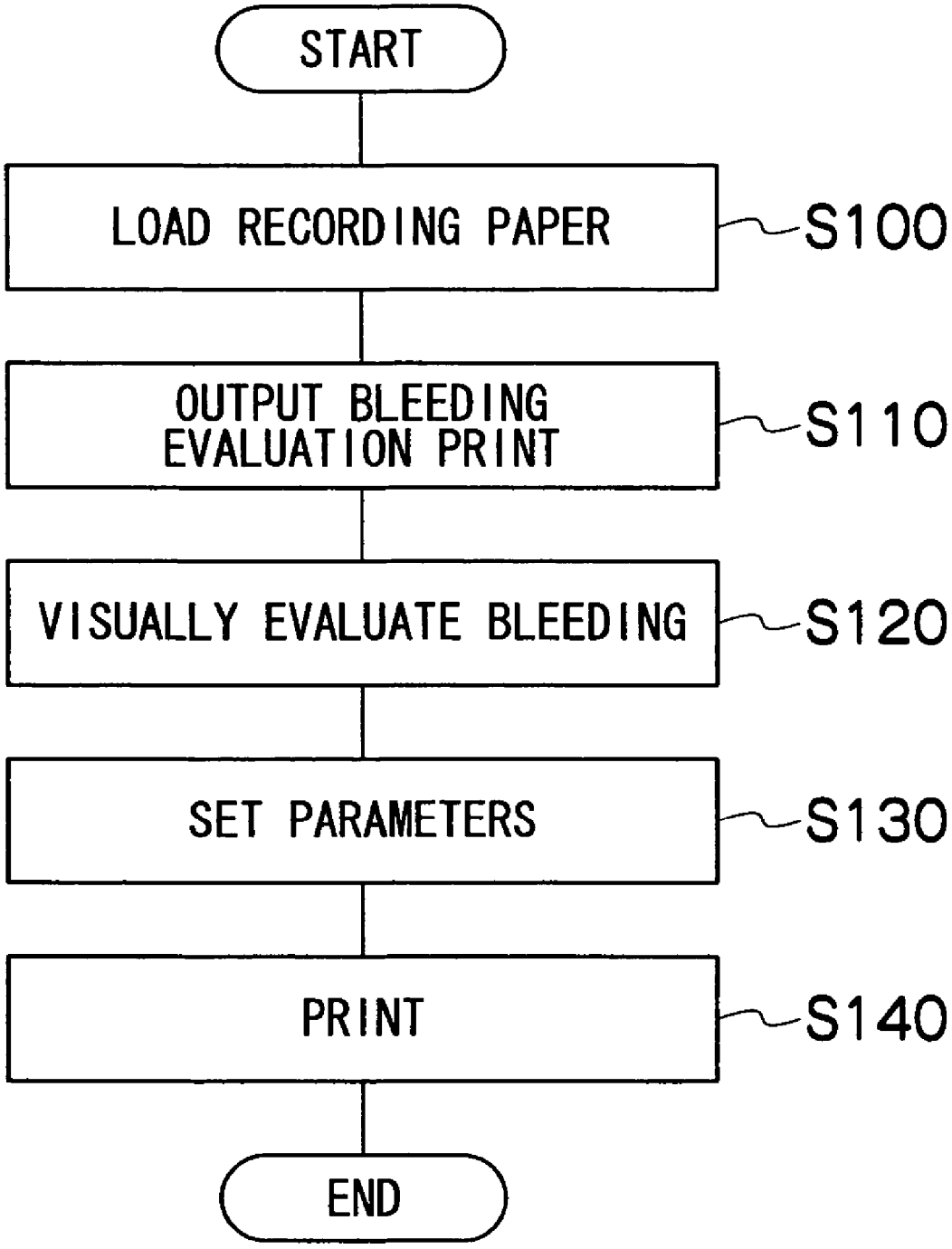
FIG. 8 is a flowchart showing the operation of the first embodiment.

First, in step S100 in FIG. 8, a magazine 22 for supplying the recording paper 16 is loaded in the inkjet recording apparatus 10. When the magazine 22 is loaded, information about the type of medium is read out from a medium type determination notch 22*a* formed in the magazine 22 by the medium type determination device 24. The information read out by the medium type determination device 24 is sent to the parameter setting device 46. Also, the ink type is determined from a cartridge or the like by the ink type determination device 25 and is similarly sent to the parameter setting device 46. The information about the type of medium and type of ink may also be inputted to the parameter-setting device 46 by the operator.

Next, in step S110, a bleeding evaluation print such as the one shown in FIG. 6 previously described is outputted from the bleeding evaluation print output device 44 by driving the print heads 12Y, 12C, 12M, and 12K via the head driver 13.

Next, in step S120, the operator visually evaluates the outputted bleeding evaluation print. Specifically, bleeding is evaluated depending on how far the line segments that gradually narrow in width and intervals for each color as shown in FIG. 7 can be observed to separate.

Next, in step S130, the control parameters are set according to the bleeding evaluation results and the objectives at the time. For example, when the operator wishes to record as quickly as possible, a combination of control parameters with a high conveyance velocity V is selected. The operator selects the patches 72 for the combination of optimum control parameters and then inputs the control parameters (conveyance velocity, discharge amount, fixing energy) to the parameter setting device 46 using the patch numbers C01, M01, etc assigned thereto.

At this time, the parameter setting device 46 stores the previously inputted medium type, ink type, and control parameters thereof accordingly, and sets the control parameters for each of the control devices.

Next, in step S140, the bleeding prevention control device 40 controls the control devices by the currently set parameters, and a high-quality, bleed-free image is recorded.

Thus, according to the present embodiment, since the operator visually evaluates bleeding with the bleeding evaluation print, bleeding can be reliably evaluated and high-quality, bleed-free images can be recorded with any recording medium.

Also, since the parameter setting device 46 stores the set control parameters according to the type of medium and the type of ink, when the next image is recorded with the same type of medium and type of ink, the stored control parameters should be read out and the bleeding evaluation print may be again outputted to set the control parameters.

Next, the second embodiment of the present invention will be described.

Figure 9:
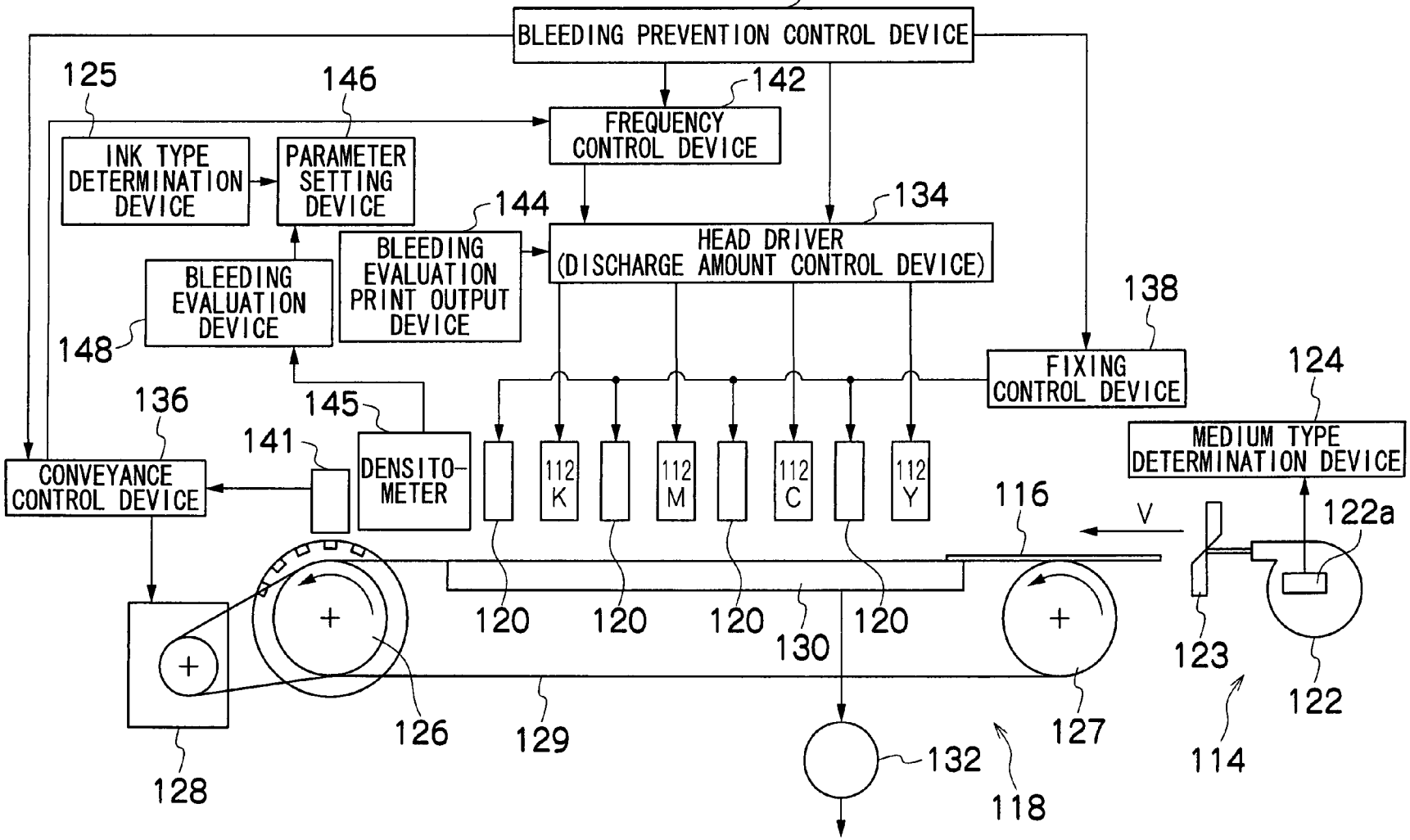
FIG. 9 is a schematic structural diagram including a partial block diagram showing the schematics of the inkjet recording apparatus relating to the second embodiment of the image recording apparatus of the present invention.

FIG. 9 is a schematic structural diagram including a partial block diagram showing the schematics of an inkjet recording apparatus relating to the second embodiment of the present invention.

As shown in FIG. 9, the inkjet recording apparatus 110 comprises: a plurality of print heads 112Y, 112C, 112M, and 112K for ink colors of yellow (Y), cyan (C), magenta (M), and black (K), respectively; a conveyance unit 118 for supplying recording paper 116 as a recording medium from a paper supply unit 114 to the print heads 112Y and the like; and a fixing device 120 for fixing the ink discharged onto the recording paper 116.

In FIG. 9, the recording paper 116 uses rolled paper (continuous paper) loaded in a magazine 122 in the paper supply unit 114 cut into specific lengths by a cutter 123, and a plurality of magazines with different paper widths and paper qualities may be jointly used. Moreover, paper may be supplied with a cassette that contains cut paper loaded in layers and that is used jointly or in lieu of a magazine for rolled paper.

In the case of the configuration in which rolled paper is used, a cutter 123 is provided as shown in FIG. 9, and the rolled paper is cut into a desired size by the cutter 123. When cut paper is used, the cutter 123 is not required.

Also, in the present embodiment, a barcode, wireless tag, or another such information-recording medium in which the information about the type of paper is recorded is attached to the medium type determination notch 122*a* of the magazine 122, and a medium type determination device 124 is provided for reading out the information in the information-recording medium. As is described later, the optimum control parameters are set in the recording medium, and image recording is performed using the information read out by the medium type determination device 124.

The recording paper 116 delivered from the magazine 122 retains curl due to having been loaded in the magazine 122. Although this is not shown in the drawing, in order to remove the curl, a decurling unit is provided, heat is applied to the recording paper 116 by a heating drum or the like in the direction opposite from the curl direction in the magazine. The heating temperature at this time is preferably controlled so that the recording paper has a curl in which the surface on which the print is to be made is slightly rounded outward.

The conveyance unit 118 has a configuration in which an endless belt 129 is set around rollers 126 and 127 so that the portion of the endless belt facing at least the nozzle face of the print heads 112K and the like forms a horizontal plane (flat plane).

The belt 129 is wider than the recording paper 116, and multiple suction holes (not shown) are formed in the belt surface. As shown in FIG. 9, a suction chamber 130 is provided to a position facing the nozzle surfaces of the print heads 112Y, 112C, 112M, and 112K in the inner side of the belt 129 applied between the two rollers 126 and 127, and the recording paper 116 is held by suction on the belt 129 by aspirating the suction chamber 130 with a fan 132 to create negative pressure.

The motive force of the motor 128 is transmitted to at least one of the rollers 126 or 127 around which the belt 129 is wound, for example, to the left roller 126, whereby the belt 129 is driven to rotate counterclockwise in FIG. 9 and the recording paper 116 held on the belt 129 is conveyed at a (relative) conveyance velocity V from the right to left side of FIG. 9.

The print heads 112Y, 112C, 112M, and 112K each have a plurality of nozzles for each color (YCMK), and are configured so that the longitudinal direction of the print heads 112Y, 112C, 112M, and 112K is aligned in the paper width direction orthogonal to the conveyed direction of the recording paper 116, thus forming a full-line head with a length corresponding to the maximum paper width.

Also, a fixing device 120 with a length corresponding to the entire width of the recording paper 116 is disposed between each of the print heads 112Y, 112C, 112M, and 112K.

Print heads 112Y, 112C, 112M, and 112K corresponding to each color are disposed along the conveyed direction of the recording paper 116 (from the right to the left side of the diagram) in the following order from the upstream side: Y (yellow), C (cyan), M (magenta), and K (black). A color image can be formed on the recording paper 116 by discharging ink of each color from the print heads 112Y, 112C, 112M, and 112K while conveying the recording paper 116 by the device of the conveyance unit 118.

In the present example, a configuration with the basic colors (four) of YCMK is described, but the combination of ink colors or the number of colors is not limited to the present embodiment, and light or dark ink may be added as necessary. For example, another possibility is a configuration including print heads for discharging light cyan, light magenta, or other such light inks.

Also, an ink type determination device 125 for determining the type of ink is provided near an ink tank (not shown) for supplying ink of each color to the print heads 112Y, 112C, 112M, and 112K. The ink type determination device 125 is not particularly limited, and may, in the case of a cartridge-type ink tank, for example, have a configuration wherein ID indicating the ink type is read out from an information medium or the like attached to the cartridge.

The fixing device 120 provides the ink discharged from the print heads 112Y, 112C, 112M, and 112K onto the recording paper 116 with fixing energy so as to fix the ink onto the recording paper 116, and a suitable device is used according to the ink employed, similar to the first embodiment previously described.

The fixing device 120 is mounted after each of the four print heads 112Y, 112C, 112M, and 112K as shown in FIG. 9, ensuring that the ink discharged from the print heads is fixed and does not bleed and that the inks do not mix together when ink is discharged near the same area from the next print head.

The present embodiment prevents the ink deposited on the recording paper 116 from bleeding and records high-quality images by variably controlling at least one of the conveyance velocity of the recording paper 116 relative to the inkjet heads (the print head 112Y and the like), the amount of ink discharged, and the fixing energy for fixing the ink deposited on the 116.

In order to achieve such bleeding prevention control, the inkjet recording apparatus 110 of the present embodiment has, in addition to the components described above, a discharge amount control device 134 for controlling the amount of ink discharged, a conveyance control device 136 for controlling the relative conveyance velocity of the recording paper 116, a fixing control device 138 for controlling the fixing energy of the fixing device 120 for fixing the ink, and a bleeding prevention control device 140 for preventing the ink from bleeding by variably controlling at least one of these three control devices, namely, the discharge amount control device 134, the conveyance control device 136, and the fixing control device 138.

The head driver for controlling the driving of the print heads 12Y, 12C, 12M, and 12K functions as the discharge amount control device 134, similar to the first embodiment previously described.

Also, an encoder 141 for determining the relative conveyance velocity in order to control the relative conveyance velocity is mounted on the roller 126. Furthermore, the inkjet recording apparatus 110 has a frequency control device 142 for controlling the discharge frequency of the print heads (112Y and the like) when the relative conveyance velocity is controlled so that the recorded image is an image with a specific dot pitch.

Also, although this is described in detail later, in order to prevent ink from bleeding and to record high-quality images, the inkjet recording apparatus 110 of the present embodiment has a bleeding evaluation print output device 144 for outputting a bleeding evaluation print used to evaluate ink bleeding, a densitometer 145 for measuring the density of the outputted bleeding evaluation print, a bleeding evaluation device 148 for evaluating ink bleeding from these measurement results, and a parameter setting device 146 for setting the optimum values of the controlled amounts as control parameters on the basis of the bleeding evaluation results.

The discharge amount control device (head driver) 134 controls the amount of ink discharged from the print heads 112Y, 112C, 112M, and 112K onto the recording paper 116, and, for example, although this is not shown in the diagram, controls the amount of ink discharged by controlling the ink internal pressure in the ink chamber or the driven amount of the actuator (piezoelectric element) that deforms the ink chamber. The size of the discharged ink droplets, or, specifically, the diameter of the ink deposited on the surface of the recording paper 116, can be controlled by controlling the amount of ink discharged.

The conveyance control device 136 controls the rotational frequency of a motor 128 on the basis of a determination signal from a rotary encoder 141. At this time, when the optimum relative conveyance velocity is parametrically set, the rotation of the motor 128 is controlled so that the relative conveyance velocity of the recording paper 116 reaches the optimum velocity.

The fixing control device 138 controls the energy in this manner according to the type of ink and the type of medium (the type of recording paper 116), and prevents bleeding by providing the ink deposited on the recording paper 116 with thermal energy or other such fixing energy to fix the ink.

The bleeding prevention control device 140 prevents the ink from bleeding by controlling at least one of the discharge amount control device (head driver) 134, the conveyance control device 136, and the fixing control device 138. The specific control method is performed by controlling each control of the devices according to the parameters set as the optimum control values by the parameter-setting device 146 as is described later.

Also, the frequency control device 142 controls the ink discharge timing from the print heads 112Y, 112C, 112M, and 112K in accordance with the relative conveyance velocity of the recording paper 116 when the velocity has changed, and ensures that the recorded image is an image with a specific dot pitch.

The system configuration of the inkjet recording apparatus 110 is substantially similar to the first embodiment previously described, and detailed descriptions are omitted.

Next, the method of setting the optimum parameters for preventing ink bleeding will be described.

In order to achieve this, first a bleeding evaluation print (bleeding evaluation pattern) is created.

This bleeding evaluation pattern is used to evaluate the manner in which the ink bleeds depending on the difference in conditions, and is created by varying the ink discharge amount (ink particle diameter $\phi$), the relative conveyance velocity V, and the fixing energy E and discharging ink from the print heads 112Y, 112C, 112M, and 112K onto the recording paper 116.

Figure 10:
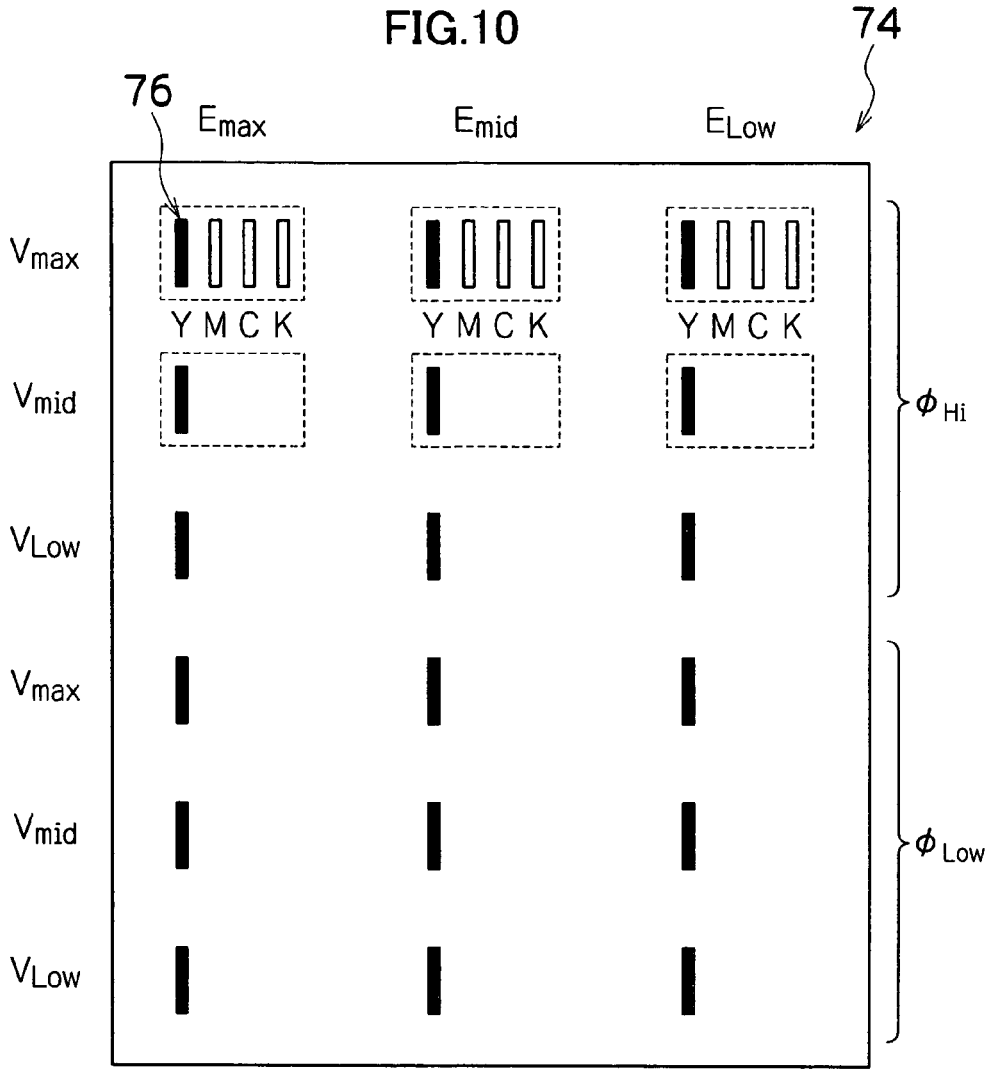
FIG. 10 is an explanatory diagram showing an example of a bleeding evaluation print in the second embodiment.

FIG. 10 shows an example of a bleeding evaluation print. As shown in FIG. 10, the bleeding evaluation print 74 is configured by varying the ink particle diameter in two stages of large $\phi_{Hi}$ and small $\phi_{low}$; varying the relative conveyance velocity V and the fixing energy E both in three stages, high, medium, and low; and recording lines (line segments) 76 of specific lengths for each ink color. Also, the bleeding evaluation print 74 is not limited to the one shown herein, and may include other parameters, for example, the printing environment temperature and moisture, or other factors relating to the bleeding of ink.

Figure 11A:
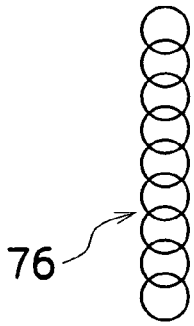
FIG. 11A is an explanatory diagram showing an enlargement of the lines in the bleeding evaluation pattern.

The lines 76 may be formed in one row of dots as shown in an enlargement in FIG. 11A, or the lines 76 may be formed in a plurality of rows of dots. In the example shown in FIG. 11A, 18 of such lines 76 are recorded for each color to form a bleeding evaluation print 74.

Figure 11B:
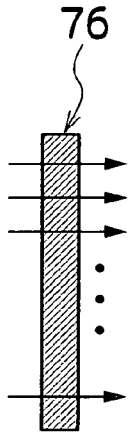
FIG. 11B is an explanatory diagram showing the manner in which the densities of the lines are measured.

After the bleeding evaluation print 74 is created, the densities of the lines 76 are measured N number of times (preferably 10 times or more) by the densitometer 145 in a direction substantially orthogonal to the lines 76, as shown in FIG. 11B. Also, the scanning resolution at this time varies in increments of several micrometers to ten and several micrometers.

Figure 12A:
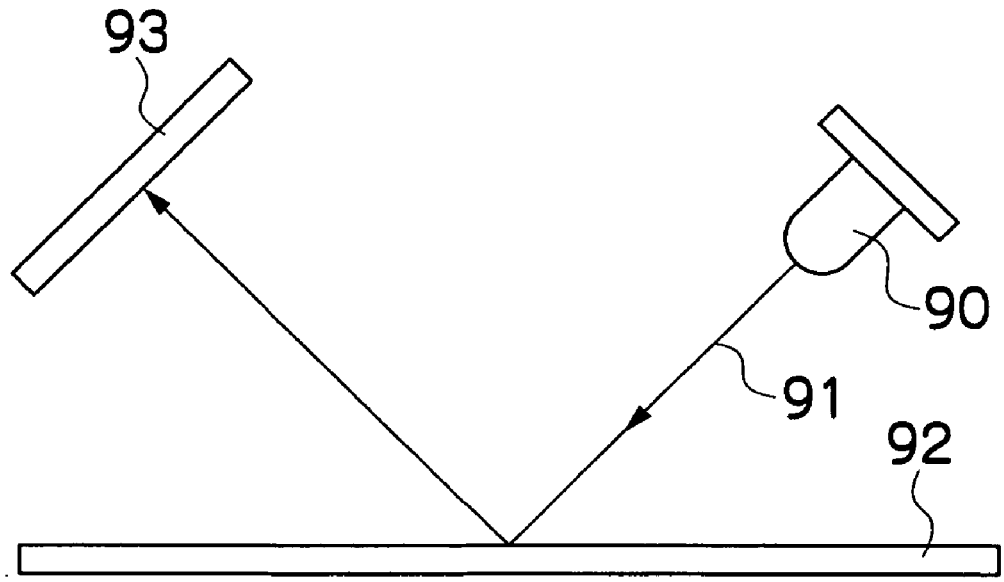
FIGS. 12A and 12B are explanatory diagrams showing the density-measuring principle.
Figure 12B:
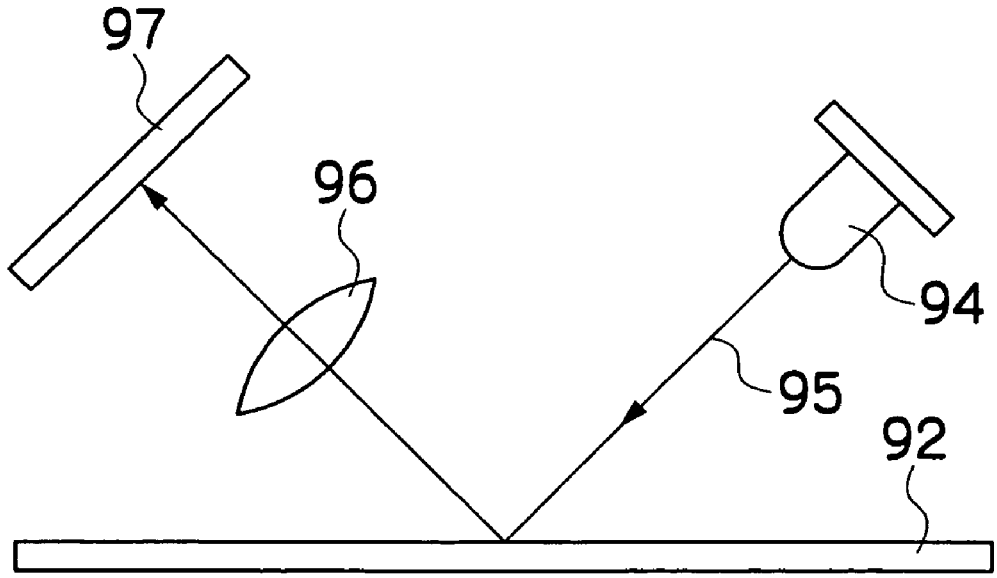

FIGS. 12A and 12B show the principles of density measurement. With the configuration shown in FIG. 12A, for example, a minute light spot 91 emitted from an RGB light emitting element 90 is directed to a measuring point on a medium 92, and the reflected light is received by a CCD element or other such light receiving element 93, whereby the density can be measured in the minute portion. At this time, an RGB light emitting diode, a filter combined with a halogen lamp, or the like are possible considerations for the RGB light-emitting element. Also, as shown in FIG. 12B, for example, area light 95 emitted from an RGB light emitting element 94 may be directed onto a measuring point on the medium 92, and the density may be measured by converging the reflected light onto an area CCD 97 with a lens 96.

Figure 13:
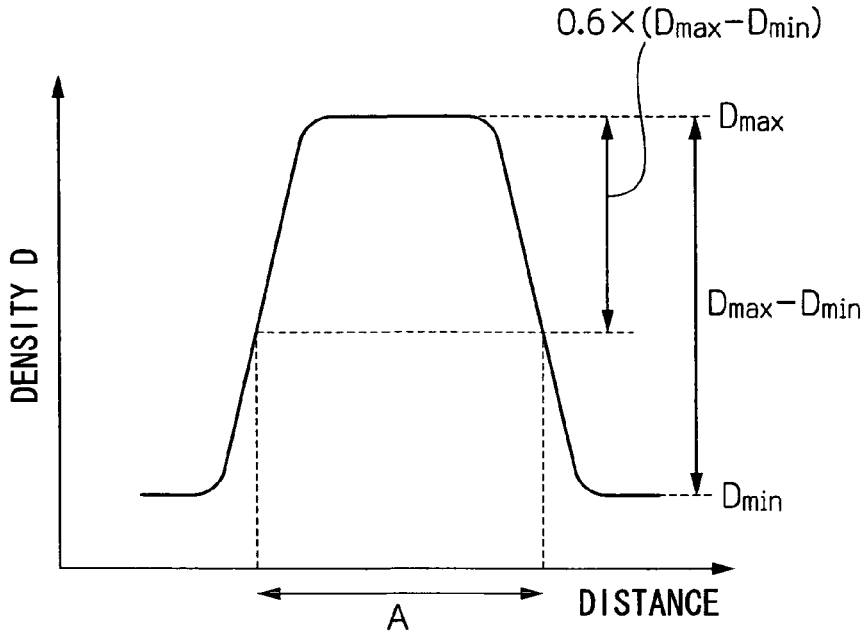
FIG. 13 is a line diagram showing the measured density profile.

FIG. 13 shows the results of measurements (single cycle). In FIG. 13, the horizontal axis is the distance, and the vertical axis is the density. The results of measuring the density are sent from the densitometer 145 to the bleeding evaluation device 148. The bleeding evaluation device 148 uses a distance A at which the density from the highest density $D_{MAX}$ is 60% of the difference between the highest density $D_{MAX}$ and the lowest density $D_{MIN}$, or, specifically, $0.6\times(D_{MAX}-D_{MIN})$, as the line widths A of the measured lines 76, and calculates the average value E(A) of the line widths A measured N number of times.

Also, the bleeding evaluation device 148 calculates the level of raggedness of the lines 76 from the results of measuring the density of the lines 76 in the following manner. The term "raggedness" (raggedness) refers to the bumpiness of the edge of lines or letters that were originally smooth and straight, and the level of raggedness is the extent of bumpiness as evaluated numerically.

Figure 14:
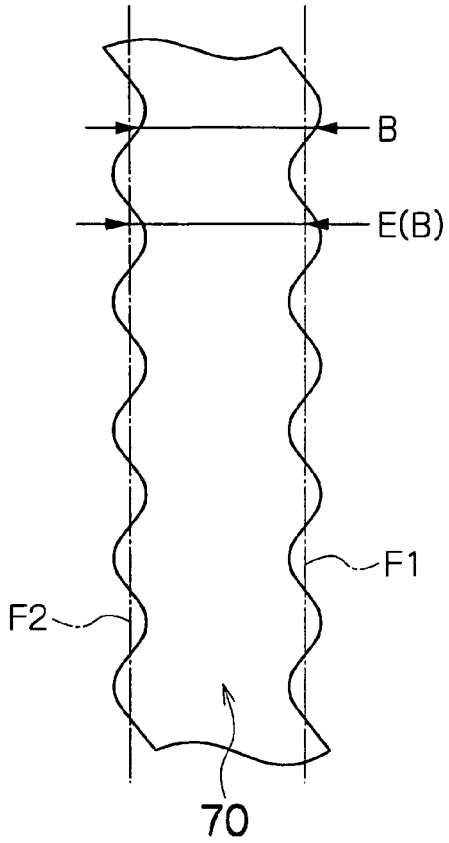
FIG. 14 is an explanatory diagram showing the manner in which the level of raggedness is measured.
Figures 15, 16:
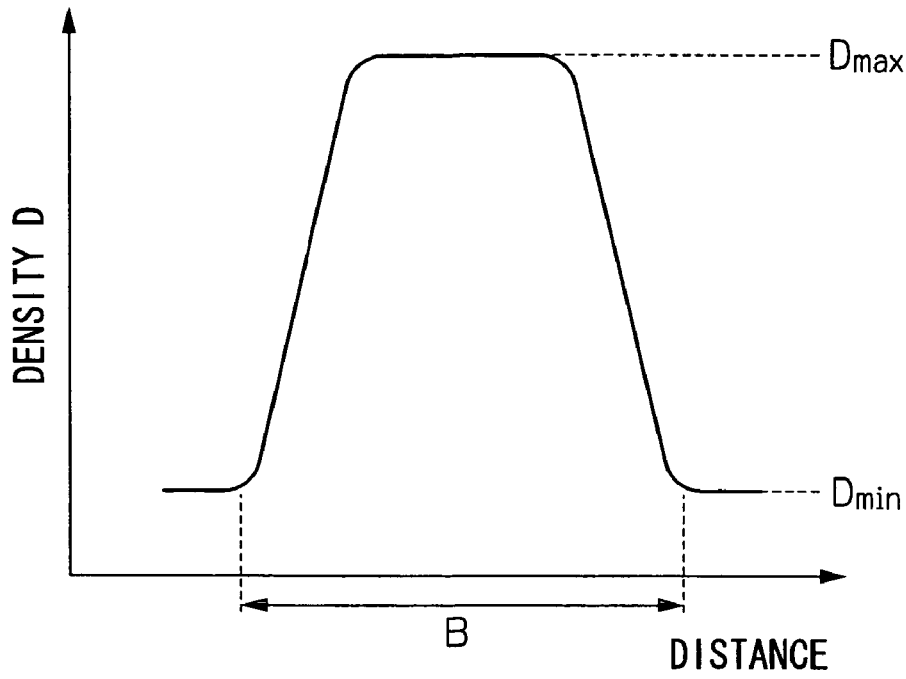
FIG. 15 is a line diagram showing the density profile when measuring the level of raggedness.
FIG. 16 is an explanatory diagram showing the bleeding prevention parameters control.

As shown in FIG. 11B, density measurement data such as is shown in FIG. 15 is obtained by measuring the width of the lines 76. Thereby, the width B indicating the actual position of the edge is calculated, the fitting straight lines F1 and F2 indicating the average positions of the edge as shown by the single dashed line in FIG. 14 are determined, and the distance E(B) between the fitting straight lines F1 and F2 are calculated. The level of raggedness is the standard deviation $\sigma_{B-E(B)}$ of the difference B−E(B) between the width B indicating the actual edge position and the average width E(B) indicating the fitting straight line positions as obtained by N measurements at different measurement locations.

Thus, two types of weighting factors, or, specifically, first weighting factors $g_1$, $g_2$, and $g_3$ specific to the apparatus, and second weighting factors $f_1$, $f_2$, and $f_3$ relating to the quality during printing are set for the highest density $D_{MAX}$ obtained by measuring the lines 76, the average value E(A) of the line widths and the level of raggedness $\sigma_{B-E(B)}$ calculated from the measured values, the preset desired density value $D_0$, and the preset desired line width value $A_B$, as shown in FIG. 16.

For example, with lines 76 composed of one row of dots as shown in FIG. 11A, the first weight coefficients $g_1$, $g_2$, and $g_3$ are roughly 1, 20, and 50, respectively, when the measured results and calculated values are 1 to 2 for the highest density $D_{MAX}$, 30 μm to 60 μm for the average line width value E(A), and 9 μm to 18 μm for the level of raggedness $\sigma_{B-E(B)}$. The first weight coefficients are thus the result of adjusting the balance of three physical quantities determined by these characteristics specific to the apparatus; namely, the highest density $D_{MAX}$, the average line width value E(A), and the level of raggedness $\sigma_{B-E(B)}$.

Also, the second weighting factors $f_1$, $f_2$, and $f_3$ are determined, for example, according to a text mode for recording only text data, an image mode for recording only images, and image quality modes for the combinations of text and image modes, as shown in FIG. 17. For example, with the text mode, line width or raggedness is emphasized more than density in order to make the edges clearer so that the text can be read more easily, and the weights $f_2$ and $f_3$ relating to line width and raggedness are assigned greater values than the weight $f_1=1$ relating to density, such as $f_2=3$ and $f_3=3$.

Thus, the second weight coefficient is a result of adjusting the balance of three physical quantities; namely, the highest density $D_{MAX}$, the average line width value E(A), and the level of raggedness $\sigma_{B-E(B)}$, in relation to the quality requirements for the image being recorded.

Ink bleeding is then evaluated using these values by the following evaluation function:

$$\text{Bleeding Evaluation Function}=|D_0-D_{MAX}|\times a_1 f_1+|A_B-E(A)|\times a_2 f_2+\sigma_{B-E(B)}\times a_3 f_3. \quad (1)$$

The bleeding evaluation device 148 evaluates ink bleeding on the recording paper 116 by means of the bleeding evaluation function using the measurement results of the densitometer 145. Also, a parameter setting device 146 sets the optimum control parameters to control bleeding for the control amounts; namely, the relative conveyance velocity, the amount of ink discharged (ink particle diameter), and the fixing energy for type of recording paper 116 and the type of ink according to the results of bleeding evaluation, and stores them in specific memory.

Also, at this time, the variable control parameters may be limited as limiting options in accordance with the attributes of the image mode, as shown in FIG. 18. For example, as shown in FIG. 18, in the text mode, the optimum fixing energy may be selected with the conveyance velocity at the maximum $V_{MAX}$, the ink particle diameter at the maximum $\phi_{Hi}$, and the fixing energy variable.

The operation of the present embodiment will now be described referring to the flowchart in FIG. 19.

Figure 19:
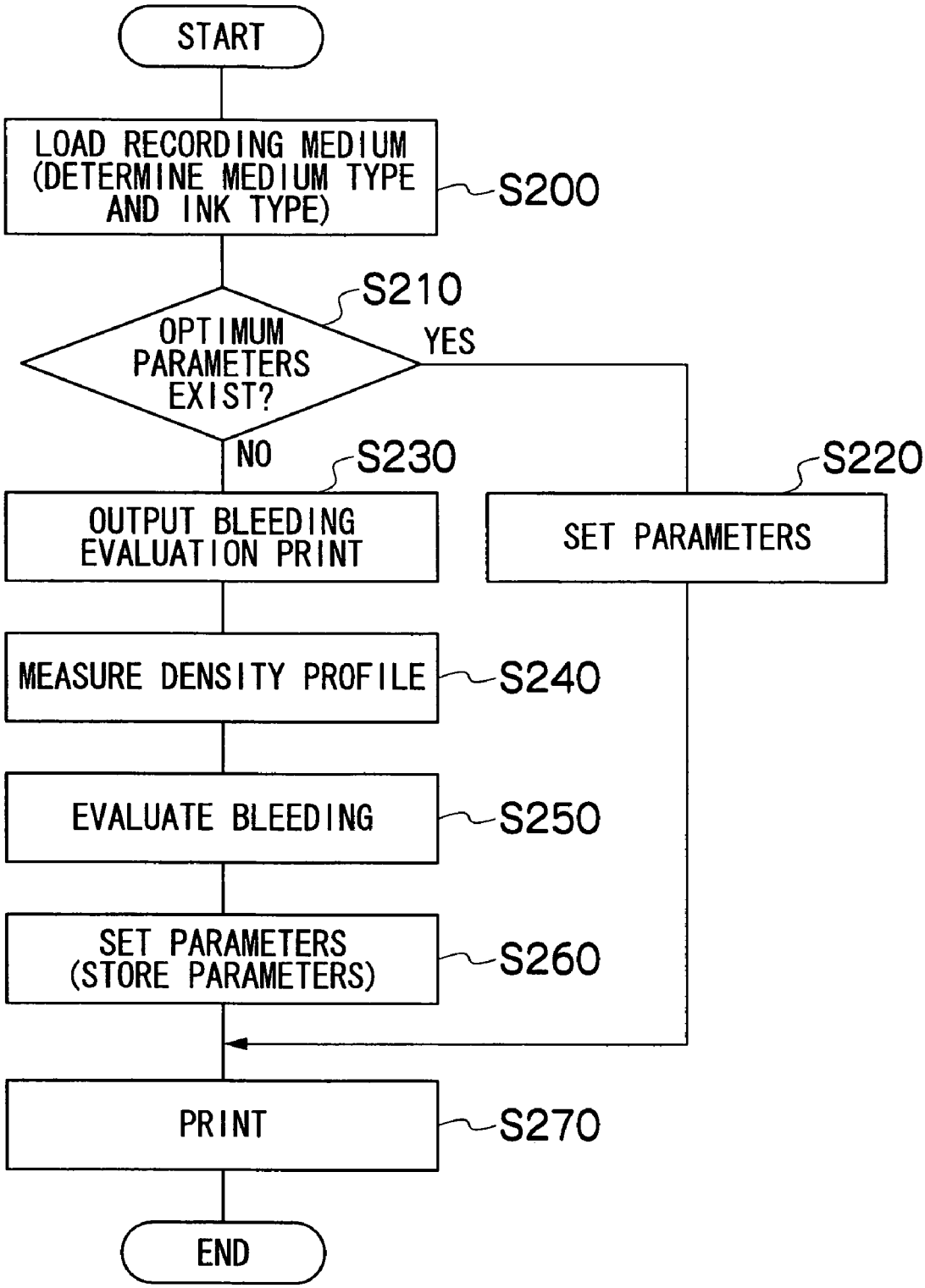
FIG. 19 is a flowchart showing the operation of the present embodiment.

First, in step S200 in FIG. 19, a magazine 122 for supplying the recording paper 116 is loaded in the inkjet recording apparatus 110. As previously described, in the magazine 122, the information recording medium on which the type of recording paper 116 loaded and other such information is recorded is attached to a medium type determination notch 122*a*, and the information is read out by a medium type determination device 124. The information read out by the medium type determination device 124 is sent to a parameter setting device 146. Also, the type of ink is determined by an ink type determination device 125, and the information about the type of ink determined is similarly sent to the parameter setting device 146.

In the next step S210, the parameter setting device 146 determines whether the optimum parameters corresponding to the sent information about the type of medium and the like have already been set and stored in a specific memory. If the optimum parameters corresponding to the type of medium and the like already exist, the process advances to step S220 and the bleeding prevention control device 140 reads out the optimum parameters for the relative conveyance velocity, the fixing energy, and the like and sets them each for the discharge amount control device (head driver) 134, the conveyance control device 136, and the fixing control device 138.

If the optimum parameters corresponding to the sent information about the type of medium and the like do not exist already, the process advances to step S230 to create an ink bleeding evaluation print for setting the optimum parameters. A dummy medium type is sent to the parameter setting device 146, and the corresponding optimum parameters are assumed to not existing, for example, when the information recording medium is not attached to the magazine 122, or when it is attached but has not been read out by the medium type determination device 124, and the process similarly advances to step S230.

In step S230, a bleeding evaluation print 74 such as is shown in FIG. 10 is created by a method such as the one previously described. Specifically, the ink particle diameter ϕ (amount of ink discharged), the relative conveyance velocity V, and the specific energy E (curing energy, drying energy) are varied; ink of each color is discharged onto the recording paper 116 from the print heads 112Y, 112C, 112M, and 112K; and lines 76 of specific lengths and specific widths are recorded, creating a bleeding evaluation print 74 such as is shown in FIG. 10.

Next, in step S240, the density of the lines 76 of the bleeding evaluation print 74 is measured multiple times by the densitometer 145 in a direction substantially orthogonal to the lines 76 as shown in FIG. 1B, and a density profile is acquired, such as is shown in FIG. 15. This measurement is performed a specific number of times (at least 10 or more) with the scanning resolution set at intervals of several micrometers to ten and several micrometers. The measured density profile is sent to the bleeding evaluation device 148.

Next, in step S250, the bleeding evaluation device 148 calculates the line width E(A), the level of raggedness $\sigma_{B-E(B)}$, and the like from the density profile of the lines 76 received from the densitometer 145; assigns these values as well as the desired value $D_0$ for density, the desired value AB for line width, the revised coefficients $a_1$, $a_2$, $a_3$, and the weight coefficients $f_1$, $f_2$, $f_3$ to the bleeding evaluation function expressed by the formula (1); and performs bleeding evaluation.

Next, in step S260, the parameter setting device 146 sets the optimum bleeding prevention parameters so that the values of the bleeding evaluation function for the numerical evaluation of bleeding are at their minimum, and stores the result in a specific memory.

Then, in step S270, these optimum parameters are used to control at least one or more of the discharge amount control device (head driver) 134, the conveyance control device 136, and the fixing control device 138 by means of the bleeding prevention control device 140, and image recording (printing) is performed. Also, printing is performed in step S270 even when the optimum parameters are set in step S220 assuming that such optimum parameters exist in step S210.

When the relative conveyance velocity is controlled, the ink discharge timing from the print heads 112Y, 112C, 112M, and 112K is controlled by the frequency control device 142 in accordance with the variation in the relative conveyance velocity of the recording paper 116 so that the recorded image is an image with a specific dot pitch. Also, it is thereby possible to record images at high speeds by varying the recording velocity according to the conditions of ink fixing.

Thus, according to the present embodiment, merely determining the type of recording medium loaded into the inkjet recording apparatus by setting the optimum control parameters for preventing ink from bleeding in advance according to the type of recording medium and ink makes it possible to easily prevent ink bleeding, to optimally control the drying and curing of ink on each medium, and to print under optimum conditions by performing printing using the control parameters. Also, varying the amount of fixing energy of the ink and the relative conveyance velocity makes it possible to create prints with reduced bleeding according to each type of medium.

Also, when the type of recording medium cannot be determined, or when the optimum control parameters for the recording medium have not been set, high-quality images wherein ink bleeding has been avoided can be recorded at high speeds by a procedure in which the optimum control parameters are set by creating a bleeding evaluation print, measuring the density, and evaluating bleeding. Also, outputting the bleeding evaluation print and evaluating bleeding by the bleeding evaluation device in this manner makes it possible to set the optimum bleeding prevention parameters for a new medium.

In the embodiments described above, the print heads are rectangular linear heads in the width direction of the recording paper, but the present invention is not limited to rectangular linear heads and can also be applied to shuttle-type heads. Specifically, a shuttle head differs only in that one line is recorded at a time in the width direction of the recording paper in a rectangular linear head, whereas a shuttle head records while scanning in the width direction of the recording paper, but is otherwise the same.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

an inkjet head which has a plurality of nozzles discharging ink onto a recording medium;

a conveyance device which performs relative conveyance of the recording medium relatively with respect to the inkjet head; and a fixing device which fixes the ink deposited on the recording medium from the plurality of nozzles, wherein the image recording apparatus records an image by discharging the ink onto the recording medium from the inkjet head while the relative conveyance by the conveyance device, and the image recording apparatus further comprises:

a conveyance control device which controls a relative conveyance velocity of the recording medium in the relative conveyance with respect to the inkjet head;

a discharge amount control device which controls an amount of the ink discharged from the inkjet head;

a fixing control device which controls a fixing energy applied by the fixing device to fix the ink deposited on the recording medium;

a bleeding prevention control device which prevents the ink deposited on the recording medium from bleeding by variation-controlling at least one of the conveyance control device, the discharge amount control device, and the fixing control device; and a bleeding evaluation print output device which outputs a bleeding evaluation print composed of a plurality of recorded bleeding evaluation patches are obtained by varying, in a plurality levels, at least one of the relative conveyance velocity, the amount of the ink discharged, and the fixing energy as a parameter, wherein the bleeding prevention control device controls the at least one of the conveyance control device, the discharge amount control device, and the fixing control device according to the bleeding evaluation print outputted by the bleeding evaluation print output device, and wherein the bleeding evaluation patches constitute a visible resolution chart composed of a plurality of line segments of a specific width that are recorded at specific intervals for respective colors so that the specific width and the specific intervals gradually decrease.

2. The image recording apparatus as defined in claim 1, further comprising:

a parameter setting device which includes at least one of a medium type determination device which determines a type of the recording medium and an ink type determination device which determines a type of the ink, the parameter setting device setting control parameters for controlling the conveyance control device, the discharge amount control device, and the fixing control device according to the outputted bleeding evaluation print and at least determined one of the type of the medium and the type of the ink, wherein the bleeding prevention control device controls the at least one of the conveyance control device, the discharge amount control device, and the fixing control device according to the set control parameters.

3. The image recording apparatus as defined in claim 1, wherein:

the bleeding prevention control device variation-controls the conveyance control device; and the image recording apparatus further comprises a frequency control device which controls a discharge frequency of the inkjet head in such a manner that the image is recorded with a prescribed dot pitch.

* * * * *